US005531392A

United States Patent [19]

Weiner

[11] Patent Number: 5,531,392

[45] Date of Patent: Jul. 2, 1996

[54] CREEL

[76] Inventor: Robert S. Weiner, 1016 Old Powers Ferry Rd., Atlanta, Ga. 30327

[21] Appl. No.: 381,084

[22] Filed: Jan. 31, 1995

[51] Int. Cl.[6] ..... D02H 1/00; D04B 27/10; B65H 57/00

[52] U.S. Cl. ..... 242/131; 28/190; 66/125 A; 112/163; 139/450; 242/157 R

[58] Field of Search ..... 242/42, 131, 157 R, 242/131.1, 157 C; 139/450; 112/163; 66/168, 125 A; 28/184, 185, 190

[56] References Cited

U.S. PATENT DOCUMENTS

| | | | |
|---|---|---|---|
| 2,728,132 | 12/1955 | Shattuck et al. | 242/157 R |
| 3,126,695 | 3/1964 | McGill | 242/131 |
| 3,291,160 | 12/1966 | Veney et al. | 242/42 |
| 3,716,203 | 2/1973 | Beasley | 242/131 |
| 4,151,943 | 5/1979 | Slonaker et al. | 242/157 R X |
| 4,180,218 | 12/1979 | Jacobs | 242/131 |
| 4,572,458 | 2/1986 | Bluhm et al. | 242/131 |
| 4,836,468 | 6/1989 | Singer | 242/131 |
| 4,865,264 | 9/1989 | Goineau | 242/131 |

*Primary Examiner*—Michael R. Mansen
*Attorney, Agent, or Firm*—Alan Ruderman

[57] ABSTRACT

A creel for feeding groups of yarn strands to a textile machine has a framework of interconnected support members and vertical posts, each post carrying a plurality of vertically spaced yarn cone holders. Each group of yarn strands is supplied from cones mounted on a group of holders on each post. The uppermost cone holder has a yarn guide tube corresponding thereto mounted on a support member with the inlet of the tube positioned for receiving a yarn from a cone mounted on the uppermost holder. Each of the other yarn cone holders has an eyelet on the frame for receiving a yarn strand from a cone mounted on the respective yarn cone holder. The yarn strand from the lowermost cone is directed by the lowermost eyelet to the next adjacent eyelet and together with the yarn from the cone on the holder associated with that eyelet directs the yarns upwardly to each subsequent eyelet and thus into the guide tube so that all of the yarns are guided by the guide tube to a header.

8 Claims, 2 Drawing Sheets

CREEL

BACKGROUND OF THE INVENTION

This invention relates to creels for use with textile machinery such as tufting machines, warping machines or the like, and particularly to a creel wherein a group of a plurality of yarn strands are received from a like number of yarn cones and are fed through a single yarn guide tube to the textile machinery.

In textile machines, such as tufting machines, yarn is fed to the machine either directly from a creel or from a warper. A creel is a frame having an array of vertical and horizontal support members and including a multiplicity of yarn cone holders. A yarn cone is a spool about which yarn is wound. There are a multiplicity of yarn cone holders provided in horizontally and vertically disposed pairs, one cone holder of the pair mounting the active yarn cone and the other mounting a reserve or magazine cone used after the active cone is emptied. Each cone holder pair has its own yarn guide tube through which yarn on each holder of the pair may be fed. A warper is a machine having a large spool, known in the art as a beam, on which yarn is wound and which subsequently supplies the yarn to a tufting machine.

In the art of tufting, generally a single strand of yarn is fed to each needle. However, there are some occasions when it may be desirable to feed a plurality of fine yarn strands to each needle for providing tufted fabrics having unique patterns. Presently, when such need arises, in order to supply more than one yarn strand to a needle of a tufting machine, the yarn strands are cabled together onto a single yarn cone, or the reserve or magazine position is also used for mounting an active cone. Cabling involves winding the plural yarns onto a single yarn cone, but yarn manufacturers merchandise yarn cones with but a single yarn thereon. Thus, cabling requires unwinding the yarns from several cones and rewinding the yarns as a group onto multi-yarn cones. Cabling is therefore inconvenient and time consuming. Magazining, on the other hand, limits to two the number of yarn strands capable of being used and thus limits the pattern potential.

SUMMARY OF THE INVENTION

Consequently, it is a primary object of the present invention to provide a yarn creel wherein a plurality of yarn cones may be fed to a single yarn guide tube for feeding a plurality of yarn strands for use by a needle of a tufting machine or for winding onto the beam of a warping machine or the like.

It is another object of the present invention to provide a yarn creel wherein the guides corresponding to a number of vertically disposed yarn spool holders are replaced by eyelets and yarn from spools mounted on those holders are directed through the respective eyelet and through vertically upper eyelets to a single yarn guide tube corresponding to a vertically uppermost yarn spool holder, the yarn on the spool mounted on the uppermost holder also being fed to the yarn guide tube so that all yarn strands on yarn cones in the group are received by the yarn guide tube and directed to a textile machine utilizing the plural strands of yarn.

It is a further object of the present invention to provide a yarn creel having groups of vertically disposed yarn holders for mounting a respective yarn cone, a yarn guide tube corresponding to the uppermost yarn cone holder of a group and having an eyelet corresponding to each of the other yarn holders of the group, each eyelet receiving a yarn strand from a yarn cone on the respective cone holder and the yarn strands corresponding to each cone mounted on cone holders vertically below it, and all of the yarn strands being received and carried by the yarn guide tube.

Accordingly, the present invention provides a creel for feeding yarn to a textile machine such as a tufting machine or a warper, the creel comprising a framework of interconnected support members, a plurality of vertically spaced yarn cone mounting members fixed to vertical support members for mounting respective yarn cones. Certain of the mounting members of each vertical support member form a group, the uppermost of the yarn cone mounting members having a yarn guide tube mounted on a frame member spaced from the support member and opposed to the mounting member for receiving and guiding a plurality of yarn strands, one of which corresponds to a cone mounted on the uppermost yarn cone support member and the others corresponding to cones mounted on each of the other yarn cone support members in the group. Each of the other mounting members of the group have an eyelet on the framework on which the guide is mounted and vertically spaced therefrom for receiving and guiding a yarn strand from a cone mounted on the corresponding yarn cone holder and yarns from each of the other lower disposed cone holders. Thus, each yarn strand of the group is fed through the corresponding eyelet to the next upper eyelet and finally to the yarn guide tube, and from the tube to the textile machine. With this arrangement, it is not necessary to cable yarns onto yarn cones as aforesaid and more than two yarn strands may be fed to a yarn using instrumentality, such as a needle, of a textile machine, such as a tufting machine.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
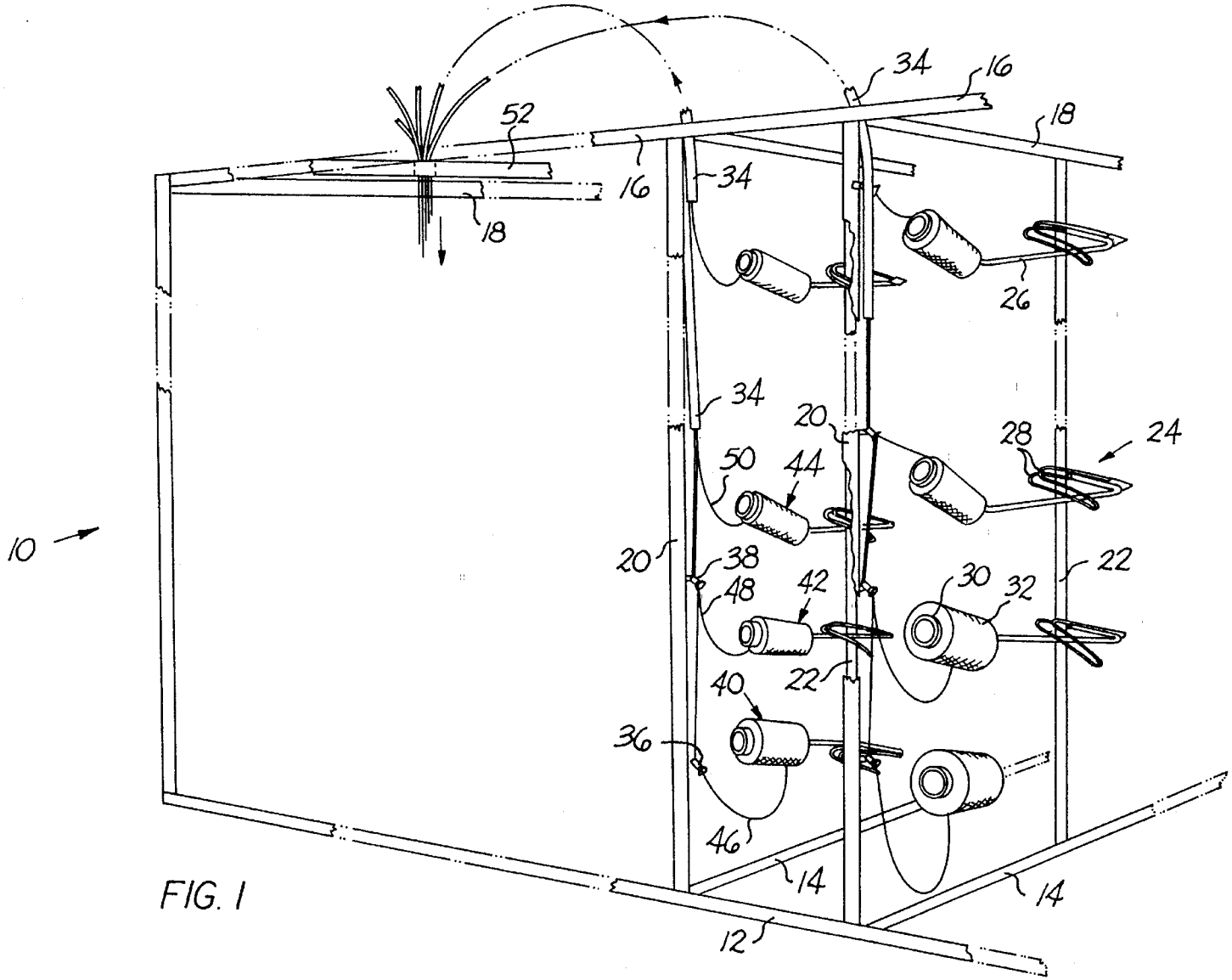
FIG. 1 is a fragmentary exploded perspective view of a creel constructed in accordance with the present invention.

A creel 10 constructed in accordance with the preferred embodiment of the present invention includes a plurality of horizontally disposed side and end support members 12, 14 forming a base of the creel, the members 14 extending substantially 90° to the members 12. Spaced above and substantially parallel to each of the horizontal support members 12, 14 is a plurality of similarly disposed side and end members 16, 18 which may form the top of the creel. Secured to and extending vertically between the side members 12, 16 are a plurality of vertical support members 20. The creel thus comprises a framework in an array of vertical and horizontal support members, it being understood that the framework includes a substantial number of similar such supports and that for purposes of presentation only a small number are illustrated in FIG. 1. The length of the sides and ends of a creel of this type, for example, may be approximately 15 to 25 feet long and extend 12 to 15 feet in height.

Secured at various locations between each pair of horizontal support members 14, 18 is a vertical creel post 22 corresponding to a vertical support member 20. Each creel post preferably comprises cylindrical pipe whereas the frame members 12, 14, 16, 18 preferably comprise angle irons. Each creel post 22 includes a plurality of pairs of vertically spaced apart cone holders 24, each cone holder being formed from metal rod bent into a U-shape form having a central portion and a pair of outstanding legs. The central portion of each cone holder is welded to the creel post 22, and each of the legs is connected to a wire form 28 on which a yarn cone 30, about which yarn 32, is wound may be frictionally held. The wire form has a free end facing a corresponding vertical support 20 and receives the yarn cone. A cone thus may be mounted on each wire form, one of the cones actively supplying yarn, while the other is a magazine or reserve cone. Each creel post may contain a single stack of yarn cone holders 24, as illustrated, or a double stack of yarn cone holders facing in opposite directions (not illustrated), i.e., a second metal rod bent in similar form to the rod 26 may be welded to the post 22 and to the back of the rod 26 and have similar wire forms such as wire form 28 mounted thereon but directed in opposite directions. In that case, a vertical support member 20 will be disposed in facing relationship with the cones mounted on the cone holders facing oppositely to those illustrated.

A creel constructed as thus described is conventional and well known in the art. In the prior art there is an elongated plastic yarn guide tube such as tube 34 corresponding to each yarn cone holder 24 mounted on the facing support member 20 and having an inlet end facing the respective cone holders and an outlet end opening in a header at the top of the creel at the end facing the textile machine served by the creel. A strand of yarn from each cone is directed into the corresponding guide tube and guided to the header where it exits and is directed to the textile machine.

Figure 2:
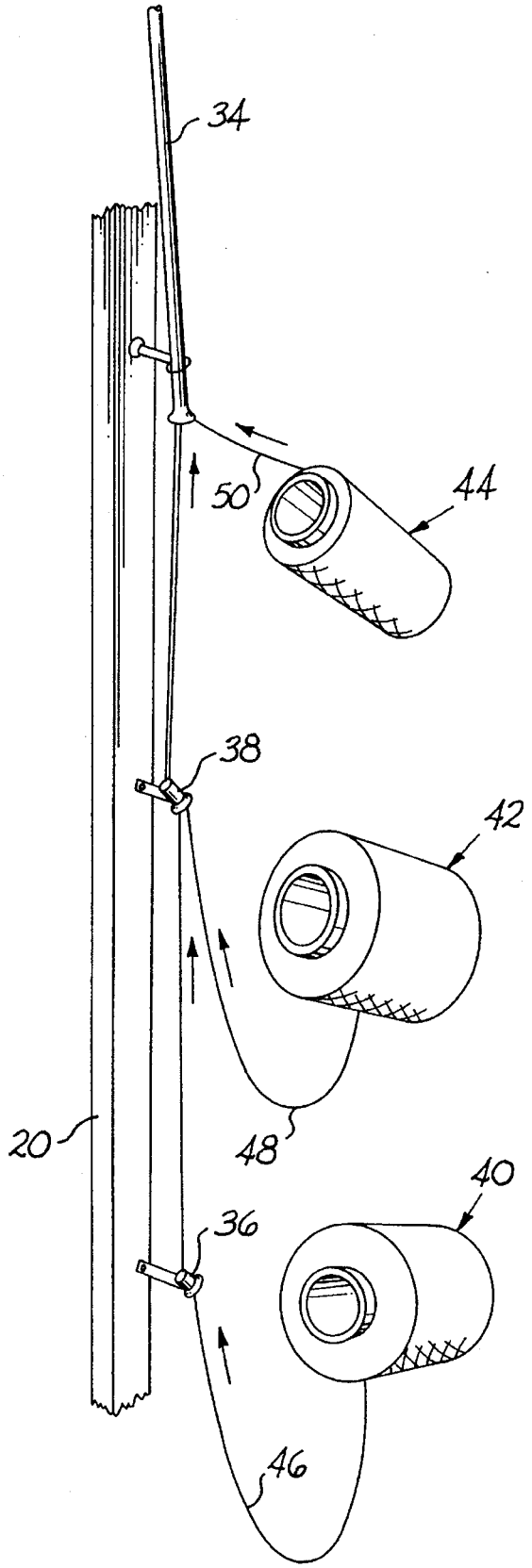
FIG. 2 is a fragmentary perspective view illustrating the manner in which yarn strands from a group of three yarn cones are guided.

In accordance with the preferred form of the invention, the yarn strands from a vertical group of yarn cones are fed to the inlet of a single guide tube 34, that guide tube being associated with the uppermost yarn cone of the group. The guide tubes associated with the other yarn cones of the group are removed from the creel and replaced by eyelets 36, 38, in the form of short plastic tubes or the like, each eyelet 36, 38 being disposed vertically for receiving a respective yarn strand from a corresponding cone holder. Thus, as best illustrated in FIG. 2, three such cones of yarn 40, 42, 44, which, of course, are mounted on respective cone holders, may form a group in which the cones are disposed vertically one above the other. The yarn strand 46 from the lowermost cone 40 is threaded into the eyelet 36 and directed upwardly into the eyelet 38. The yarn strand 48 from the next cone 42, which is vertically above the cone 40, is threaded into the eyelet 38 and directed upwardly. Thus, both yarn strands 46 and 48 are threaded into the eyelet 38 and directed upwardly. The yarn strands 46 and 48 together with the yarn strand 50 on the uppermost cone 44 are thereafter threaded into the inlet of the guide tube 34. If it is desired to supply more than three yarn strands as a group to a needle of a tufting machine or the yarn using instrumentality of another textile machine, there would be other yarn cones disposed intermediate the cones 42 and 44, the number of such cones being dependent upon the number of additional yarn strands desired in the group. Each such additional yarn strand would be fed to a corresponding additional eyelet which would also receive the yarn strands 46 and 48 and all of such yarn strands would together with the yarn strand 50 be directed into the tube 34.

Each tube 34 extends into a header 52 at the top of the end of the creel most adjacent to the textile machine served, i.e., at the left end of the creel illustrated in FIG. 1. The yarn strands from each guide tube at the header are then withdrawn and sent to the textile machine. For example, the yarn strand from each tube may be guided and threaded into the eye of a needle so that the needle will tuft or sew with the plurality of yarn strands 46, 48, 50. It should be understood that since each yarn cone 40, 42, 44 is mounted on a respective yarn cone holder 24, the plurality of yarn cone holders corresponding to the yarn cones 40, 42, 44, etc. form a group of vertically disposed holders, each of which has a corresponding eyelet 36, 38, etc. with the uppermost cone holder corresponding to the yarn tube 34.

With the construction of the present invention there is but a single guide tube for each group of yarns. Since a tufting machine, for example, may have 1000 to 1500 needles, the number of guide tubes would total that amount. On the other hand, if there was a guide tube corresponding to and carrying but a single yarn strand, a group of three yarns to be fed to a single needle would require 3000 to 4500 tubes and the yarns exiting the header would cause confusion for those threading the machine.

Numerous alterations of the structure herein disclosed will suggest themselves to those skilled in the art. For example, two yarn strands may be fed, one of which is associated with an eyelet and the other with a guide tube, Also, rather than the cones of a group being in a vertical array, they may be in a horizontal array. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of feeding a group of at least two yarn strands to a textile machine using said yarn strands from a creel having a plurality of yarn cones mounted in an array including at least a first yarn cone and a second yarn cone, said method comprising directing a first strand of yarn from said first cone to an eyelet spaced laterally from said first cone, guiding said first strand of yarn through said eyelet to an inlet of an elongated guide tube having said inlet spaced vertically above said eyelet, directing a second strand of yarn from said second cone into said inlet, and feeding said first and second strands of yarn through said guide tube into a header towards said machine.

2. A method of feeding at least three yarn strands to a textile machine using said yarn strands from a creel having a plurality of yarn cones mounted in an array including at least a first yarn cone, a second yarn cone and at least a third yarn cone intermediate said first and second cones, said method comprising directing a first strand of yarn from said first cone to an eyelet spaced laterally from said first cone, guiding said first strand of yarn through said first eyelet to another eyelet spaced vertically above said first eyelet, directing another strand of yarn from said third cone to said another eyelet, guiding said first and said another strands of yarn through said another eyelet into an inlet of an elongated tube having said inlet spaced vertically above said another eyelet and spaced Vertically further from said first eyelet, directing a second strand of yarn from said second cone into said inlet, and feeding said first, second and another strands of yarn through said guide tube into a header toward said machine.

3. A method of feeding a group of at least three yarn strands to a textile machine using said yarn strands from a creel having a plurality of yarn cones mounted in a vertical array including a lowermost yarn cone, an uppermost yarn cone and at least one yarn cone intermediate said lowermost and uppermost cones, said method comprising directing a first strand of yarn from said lowermost cone to a first eyelet spaced laterally from said lowermost cone, guiding said first strand of yarn through said first eyelet to a second eyelet spaced vertically above said first eyelet, directing a second strand of yarn from a cone intermediate said lowermost and uppermost cone to said second eyelet, guiding said first and second strands of yarn through said second eyelet into an inlet of an elongated guide tube having said inlet spaced vertically above said second eyelet, directing a third strand of yarn from said uppermost cone into said inlet, and feeding said first, second and third strands of yarn through said guide tube into a header towards said machine.

4. A method of feeding a group of at least two yarn strands to a textile machine using said yarn strands from a creel having a plurality of yarn cones mounted in a vertical array including at least a lower yarn cone and an upper yarn cone, said method comprising directing a first strand of yarn from said lower cone to a first eyelet spaced laterally from said lower cone, guiding said first strand of yarn through said first eyelet to an inlet of an elongated guide tube having said inlet spaced vertically above said eyelet, directing a second strand of yarn from said upper cone into said eyelet, and feeding said first and second strands of yarn through said guide tube into a header toward said machine.

5. A creel for use with textile machinery having an array of vertical and horizontal support members, a header at a top portion of said creel, a plurality of vertical cone support posts, each cone support post having a plurality of cone holders for receiving and mounting corresponding cones of yarn, several of said plurality of cone holders of each post defining a group having a lowermost cone holder, an uppermost cone holder and at least one cone holder intermediate said lowermost and uppermost cone holders, a bottom eyelet spaced laterally from said lowermost cone holder and disposed vertically for receiving a yarn strand from a cone of yarn mounted on said lowermost cone holder, a single guide tube associated with said group, said guide having an inlet spaced laterally from said uppermost cone holder and disposed vertically for receiving a yarn strand from a cone of yarn mounted on said uppermost cone holder and extending from said inlet into said header, and an eyelet spaced laterally from each cone holder intermediate said lowermost and uppermost cone holders and disposed vertically for receiving a yarn strand from a cone of yarn mounted on a respective cone holder intermediate said lowermost and uppermost cone holders, said eyelets and said inlet of said guide tube being substantially vertically aligned whereby yarn from each eyelet may be received from a lower eyelet and be directed into said inlet, whereby the yarn from all of said cones from said group are received by said guide tube and fed into said header.

6. A creel as recited in claim 5, wherein each of said cone holders has a free end for receiving a respective yarn cone, the free end of each cone holder of said group facing respective eyelets and said guide tube inlet.

7. A creel for use with textile machinery having an array of vertical and horizontal support members, a header at the top of said creel, a plurality of vertical cone support posts, at least one of said vertical support members being disposed adjacent to and associated with each post, each cone support post having a plurality of cone holders for receiving and mounting corresponding cones of yarn, several of said plurality of cone holders of each post defining a group having a lowermost cone holder, an uppermost cone holder and at least one cone holder intermediate said lowermost and uppermost cone holders, each vertical support member having (a) a bottom eyelet corresponding to the lowermost cone holder, (b) a guide tube having an inlet corresponding to the uppermost cone holder and extending into said header, and (c) an eyelet corresponding to each cone holder intermediate said lowermost and uppermost cone holders of the post associated therewith, said eyelets and said inlet of said guide tube being substantially vertically aligned for receiving yarn from a cone of yarn mounted on the cone holder corresponding thereto and for directing the yarn upwardly from the eyelet corresponding to the lowermost cone holder to the other eyelets and to the inlet of the guide to said header.

8. A creel as recited in claim 7 wherein each of said cone holders has a free end for receiving a respective yarn cone, the free end of each cone holder of said group facing respective eyelets and said guide tube inlet.

* * * * *